US010975694B2

(12) United States Patent
Ju et al.

(10) Patent No.: US 10,975,694 B2
(45) Date of Patent: Apr. 13, 2021

(54) MINE FIELD LAYOUT METHOD SUITABLE FOR FLUIDIZED MINING OF COAL RESOURCES

(71) Applicants: CHINA UNIVERSITY OF MINING AND TECHNOLOGY, BEIJING, Beijing (CN); SHENZHEN UNIVERSITY, Guangdong (CN)

(72) Inventors: Yang Ju, Beijing (CN); Heping Xie, Guangdong (CN); Yong Zhang, Beijing (CN); Yan Zhu, Beijing (CN); Feng Gao, Jiangsu (CN); Xiaodong Nie, Beijing (CN); Changbing Wan, Beijing (CN); Jinxin Song, Beijing (CN); Chang Lu, Beijing (CN); Hongbin Liu, Beijing (CN); Zhangyu Ren, Beijing (CN)

(73) Assignees: CHINA UNIVERSITY OF MINING AND TECHNOLOGY, BEIJING, Beijing (CN); SHENZHEN UNIVERSITY, Guangdong (CN)

( * ) Notice: Subject to any disclaimer, the term of this patent is extended or adjusted under 35 U.S.C. 154(b) by 124 days.

(21) Appl. No.: 16/467,490

(22) PCT Filed: Mar. 23, 2018

(86) PCT No.: PCT/CN2018/080196
§ 371 (c)(1),
(2) Date: Jun. 6, 2019

(87) PCT Pub. No.: WO2019/178838
PCT Pub. Date: Sep. 26, 2019

(65) Prior Publication Data

US 2021/0003008 A1 Jan. 7, 2021

(51) Int. Cl.
*E21C 41/16* (2006.01)
*E21C 41/18* (2006.01)
*E21C 45/00* (2006.01)

(52) U.S. Cl.
CPC ..... *E21C 41/18* (2013.01); *E21C 41/16* (2013.01); *E21C 45/00* (2013.01)

(58) Field of Classification Search
CPC ..... E21C 41/16; E21C 41/18
(Continued)

(56) References Cited

FOREIGN PATENT DOCUMENTS

CN 101649741 A 2/2010
CN 102383772 A 3/2012
(Continued)

OTHER PUBLICATIONS

International Search Report for PCT/CN2018/080196 dated Dec. 27, 2018, ISA/CN.

*Primary Examiner* — Sunil Singh
(74) *Attorney, Agent, or Firm* — Yue (Robert) Xu; Apex Attorneys at Law, LLP

(57) ABSTRACT

A mine field layout method suitable for fluidized mining of coal resources is provided. A main shaft and an air shaft are provided in the mine field, the bottom of the main shaft is located in the shallow horizontal coal seam zone, and the bottom of the air shaft is located in the deep horizontal coal seam zone. The horizontal main roadways are arranged at two boundaries along the strike of the coal seam, and inclined main roadways are arranged at two boundaries along the dip direction of the coal seam. Connecting roadways are located inside the mine field and are in communication with the horizontal main roadways. In the coal mining stage, the coal resources can be converted into the fluidized energy product and/or electricity by an unmanned automatic mining machine.

12 Claims, 3 Drawing Sheets

(58) Field of Classification Search
USPC ..... 299/11, 12, 19
See application file for complete search history.

(56) References Cited

FOREIGN PATENT DOCUMENTS

| | | | |
|---|---|---|---|
| CN | 104234714 | A | 12/2014 |
| CN | 107558984 | A | 1/2018 |
| RU | 2190765 | C2 | 10/2002 |

MINE FIELD LAYOUT METHOD SUITABLE FOR FLUIDIZED MINING OF COAL RESOURCES

This application is the national phase of International Application No. PCT/CN2018/080196, titled "MINE FIELD LAYOUT METHOD SUITABLE FOR FLUIDIZED MINING OF COAL RESOURCES", filed on Mar. 23, 2018, the entire disclosure of which is incorporated herein by reference.

FIELD

The present application relates to the technical field of mineral mining, and in particular to a mine field layout method suitable for fluidized mining of coal resources.

BACKGROUND

During the underground mining of coal mines, a mine field generally has a large area, a strike length of the mine field can reach several kilometers or even tens of thousands of meters, and the length in the dip direction can reach several kilometers. Therefore, in order to regularly mine underground coal resources, the mine field should be divided into several small parts.

The mine field is usually divided into multiple stages and levels, and further divided into several mining areas in each stage, or the mine field is directly divided into multiple panels or strips. Regardless of using which division method, in order to meet the requirements such as coal lifting, coal transportation, ventilation, drainage and power supply, mine workings such as multiple shafts, a large number of roadways and chambers must be excavated. It can be seen that the mine field division method suitable for the traditional mining method requires a large amount of roadway excavation, and high construction and maintenance cost of the roadways.

In addition, in order to maintain the stability of the roadways, a large number of coal pillars are left among the coal mining working faces, sections and mining areas, so that a large quantity of coal is wasted and the recovery ratio is low; and even if the recovery of residual coal pillars is carried out later, the process is complicated and the cost is high.

SUMMARY

In view of this, an object of the present application is to provide a mine field layout (also referred to as a mine layout) method suitable for fluidized mining of coal resources, to solve the technical problems in the conventional mining method that the number of the roadways that needs to be excavated in the mine field is large and the construction and maintenance cost of the roadways is high.

A mine field layout method suitable for fluidized mining of coal resources is provided, the mine field includes a first boundary extending along a strike of a coal seam and located in a shallow horizontal coal seam zone, a second boundary extending along the strike of the coal seam and located in a deep horizontal coal seam zone, a third boundary extending along a dip direction of the coal seam and a fourth boundary extending along the dip direction of the coal seam, and the first boundary, the second boundary, the third boundary, and the fourth boundary form a quadrilateral mine field area, and the mine field layout method includes:

providing a main shaft and an air shaft, wherein a bottom of the main shaft is located at one end of the first boundary, and a bottom of the air shaft is located at one end of the second boundary;

providing a first horizontal main roadway and a second horizontal main roadway, wherein the first horizontal main roadway extends along the first boundary, and the second horizontal main roadway extends along the second boundary;

providing a first inclined main roadway and a second inclined main roadway, wherein the first inclined main roadway extends along the third boundary, and the second inclined main roadway extends along the fourth boundary;

providing one or more connecting roadways, wherein the one or more connecting roadways are located inside the mine field, extend along the dip direction of the coal seam and are each in communication with the first horizontal main roadway and the second horizontal main roadway;

providing a shaft station, wherein the shaft station is located at a bottom of the main shaft;

providing a mine field sump, wherein the mine field sump is located within a preset range of a bottom of the air shaft and is configured to store water extracted from coal and rock seams;

providing a fluidized conversion chamber, wherein the fluidized conversion chamber is located in the shaft station and is configured to convert the coal resources mined during excavating the roadways into at least one of a fluidized energy product and electricity;

providing a shaft station sump, wherein the shaft station sump is located in the shaft station and is configured to store water extracted when constructing the chamber; and providing energy transmission pipelines, wherein the energy transmission pipelines are arranged in the first horizontal main roadway, the second horizontal main roadway, the first inclined main roadway, the second inclined main roadway, the one or more connecting roadways and the main shaft, and are configured to transmit energy to an unmanned automatic mining machine in the mine field and to transport at least one of the fluidized energy product and electricity converted from coal resources to the ground.

Optionally, the bottom of the main shaft and the bottom of the air shaft are at diagonal positions in the quadrilateral mine field area.

Optionally, the layout method further includes: providing a gas power station in the shaft station, wherein the gas power station is configured to convert gas extracted from the coal seam during excavating the roadways into electricity.

The mine field layout method further includes: providing filling boreholes and filling pipelines; wherein, the filling boreholes extend from the ground to the one or more connecting roadways, and are configured to transport filling slurry to the one or more connecting roadways; and the filling pipelines are arranged in the one or more connecting roadways and are in communication with the filling boreholes, and are configured to transport the filling slurry to a goaf.

Optionally, an installation angle of the filling pipelines is the same as an inclination angle of the one or more connecting roadways.

Optionally, the layout method further includes:

providing a first filling wall behind the unmanned automatic mining machine when the goaf is being filled, wherein a plane of the first filling wall is perpendicular to a direction of a coal mining route.

Optionally, the mine field layout method further includes: providing a second filling wall at an intersection of the goaf and the connecting roadway when the goaf is being filled and the goaf is intersected with the contacting roadway, and the plane of the second filling wall is perpendicular to the contacting roadway.

Optionally, the energy transmission pipelines include energy charging pipelines and energy extracting pipelines;

the energy charging pipelines are configured to transport energy for normal operation of the unmanned automatic mining machine; and the energy extracting pipelines are configured to transport the fluidized energy product and electricity converted from coal resources to the ground.

Optionally, the energy transmission pipelines in the first horizontal main roadway, the second horizontal main roadway, the first inclined main roadway, the second inclined main roadway and the one or more connecting roadways include: energy charging pipelines, energy extracting pipelines and gas transportation pipelines;

the energy charging pipelines are configured to transport energy for normal operation of the unmanned automatic mining machine;

the gas transportation pipelines are configured to transport the gas extracted from the coal seam to the gas power station, to allow the gas power station to convert the gas into electricity by; and the energy extracting pipelines are configured to transport at least one of the fluidized energy product and electricity converted from coal resources by the unmanned automatic mining machine to the energy transmission pipelines in the main shaft, to allow the energy transmission pipelines in the main shaft to transport at least one of the fluidized energy product and electricity converted from coal resources to the ground.

Optionally, intersections of the roadways are each arranged in a shape of a circular arc.

A mine field layout method suitable for fluidized mining of coal resources is provided according to an embodiment of the present application, the mine field is a quadrilateral area, the quadrilateral area includes a first boundary and a second boundary both extending along the strike of a coal seam, and a third boundary and a fourth boundary both extending along the dip direction of the coal seam. The first boundary is located in a shallow horizontal coal seam zone, and the second boundary is located in a deep horizontal coal seam zone. The main shaft and the air shaft are excavated downward from the ground corresponding to the mine field, the bottom of the main shaft is located at one end of the first boundary, and the bottom of the air shaft is located at one end of the second boundary. The first horizontal main roadway is formed along the first boundary, the second horizontal main roadway is formed along the second boundary, the first inclined main roadway is formed along the third boundary, and the second inclined main roadway is formed along the fourth boundary. The connecting roadways are formed along the dip direction of the coal seam inside the mine field and are in communication with the first horizontal main roadway and the second horizontal main roadway. In the coal mining stage, the mined coal resources can be directly converted into the fluidized energy product and/or electricity by the unmanned automatic mining machine by using the fluidized mining method in the mine. The energy transmission pipelines arranged in the main shaft, the first horizontal main roadway, the second horizontal main roadway, the first inclined main roadway, the second inclined main roadway and the connecting roadways are configured to transport energy to the coal mining machine in the mine and also to transport the energy converted from the coal resources to the ground. It can be seen that only two vertical shafts (a main shaft and an air shaft), four main roadways, one or more connecting roadways needs to be constructed in the mine field, thus it is not necessary to construct shafts for coal lifting and transportation, and the number of shafts for drainage, ventilation, and power supply is reduced. Therefore, the construction and maintenance costs of the roadway are reduced. In addition, there is basically no residual coal pillar left in the mine field, and the recovery ratio is high.

BRIEF DESCRIPTION OF THE DRAWINGS

For more clearly illustrating embodiments of the present application or the technical solution in the conventional technology, drawings referred to describe the embodiments or the conventional technology will be briefly described hereinafter. Apparently, the drawings in the following description are only several embodiments of the present application, and for the person skilled in the art other drawings may be obtained based on these drawings without any creative efforts.

DETAILED DESCRIPTION

For the mine field using the traditional mining methods, in order to meet the requirements such as lifting, transportation, ventilation, drainage and power supply, mine workings such as multiple shafts, a large number of roadways and chambers must be excavated in the mine field, resulting in very high construction and maintenance costs of the mine field. A mine field layout method suitable for fluidized mining of coal resources is provided according to an embodiment of the present application. Two vertical shafts are drilled from the ground at two diagonal positions in the mine field, namely the main shaft and the air shaft, respectively. The bottom of the main shaft is located at a shallow horizontal coal seam zone, and the bottom of the air shaft is located at a deep horizontal coal seam zone. At the boundary of the mine field, two horizontal main roadways are respectively arranged along the strike of the coal seam, and two inclined main roadways are respectively arranged along the dip direction of the coal seam. One or more connecting roadways are arranged inside the mine field, and are in communication with the two horizontal main roadways. Energy transmission pipelines are arranged in the main shaft, the horizontal main roadways, the inclined main roadways and the connecting roadways and are configured to provide energy to a coal mining machine in the mine and also to transport the fluidized energy product and/or electricity obtained by conversion to the ground. It can be seen that only two vertical shafts (the main shaft and the air shaft), four main roadways, one or more connecting roadways need to be constructed in the mine field suitable for fluidized mining, thus the construction number of the roadways is reduced. Therefore, the construction and maintenance costs of the roadways are reduced. In addition, there is basically no residual coal pillar left in the mine field, and thus the recovery ratio is high.

In order to make the purposes, features, and advantage of the present application more apparent and easy to understand, the technical solutions in the embodiments of the present application will be described clearly and completely hereinafter in conjunction with the drawings in the embodiments of the present application. Apparently, the described embodiments are only a part of the embodiments of the present application, rather than all embodiments. Based on the embodiments in the present application, all of other embodiments, made by the person skilled in the art without any creative efforts, fall into the scope of the present application.

Figure 1:
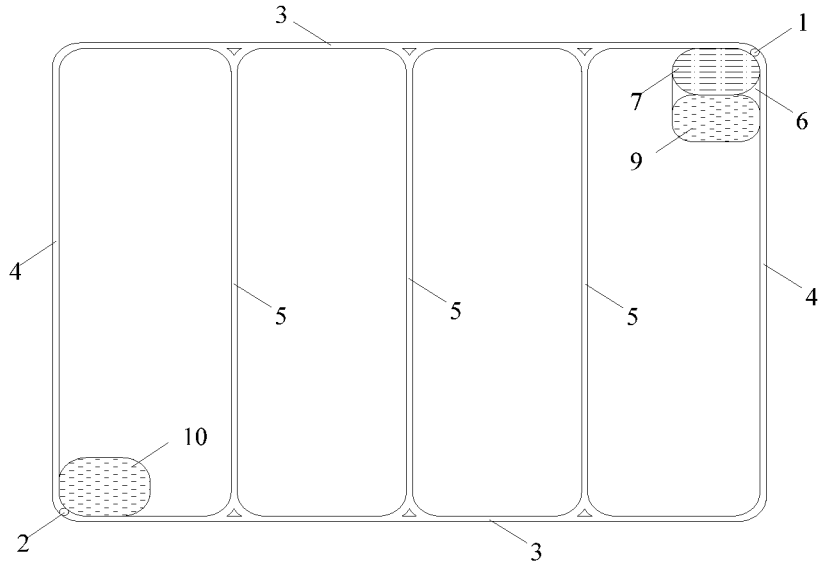
FIG. 1 is a schematic top view showing the structure of a mine field layout suitable for fluidized mining of coal resources according to an embodiment of the present application.
Figure 2:
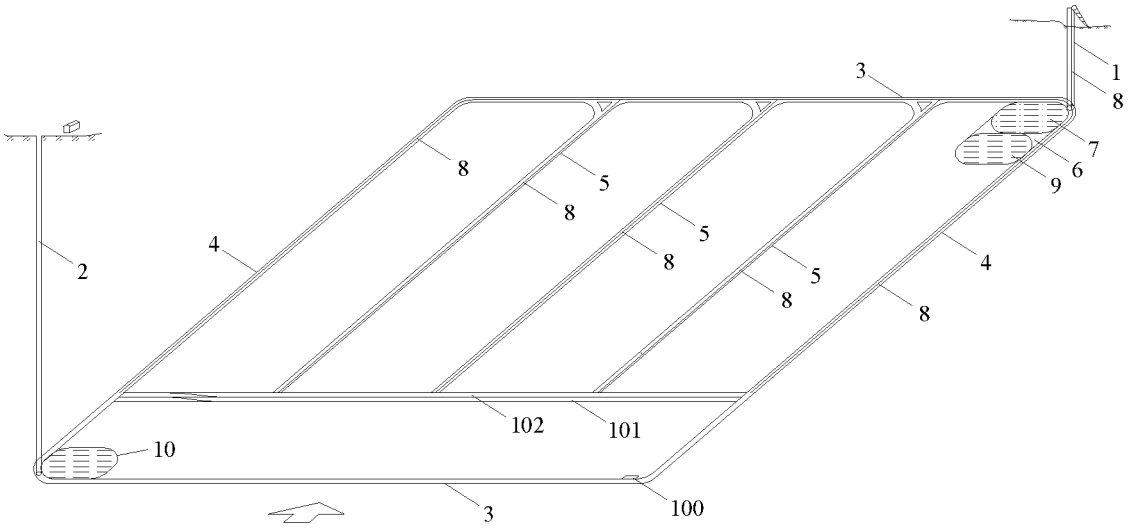
FIG. 2 is a schematic view showing an arrangement of pipelines in a mine field layout according to an embodiment of the present application.

Referring to FIGS. 1 and 2, FIG. 1 is a schematic top view showing the structure of a mine field layout suitable for fluidized mining of coal resources according to an embodiment of the present application, and FIG. 2 is a schematic view showing an arrangement of pipelines in a mine field layout according to an embodiment of the present application.

As shown in FIGS. 1 and 2, a mind field obtained by using the mine field layout method suitable for fluidized mining of coal resources is provided with a main shaft 1, an air shaft 2, horizontal main roadways 3, inclined main roadways 4, connecting roadways 5, a shaft station 6, a fluidized conversion chamber 7, energy transmission pipelines 8, a shaft station sump 9 and a mine field sump 10.

A mine field layout method suitable for fluidized mining of coal resources according to an embodiment of the present application includes the following processes.

The entire mine field is formed as a quadrilateral mining area, that is, a quadrilateral mine field. The quadrilateral mine field includes a first boundary and a second boundary both extending along the strike of a coal seam, and a third boundary and a fourth boundary both extending along the dip direction of the coal seam. The first boundary is located in a shallow horizontal coal seam zone, and the second boundary is located in a deep horizontal coal seam zone.

The main shaft 1 is excavated downward from the ground corresponding to one end of the first boundary, and the bottom of the main shaft 1 is located in the shallow horizontal coal seam zone. The air shaft 2 is excavated downward from the ground corresponding to one end of the second boundary, and the bottom of the air shaft 2 is located in the deep horizontal coal seam zone.

The horizontal main roadways 3 are excavated along the first boundary and the second boundary respectively, that is, the first horizontal main roadway and the second horizontal main roadway. The inclined main roadways 4 are excavated along the third boundary and the fourth boundary respectively, that is, the first inclined main roadway and the second inclined main roadway.

Inside the mind field, one or more connecting roadways 5 are excavated along the dip direction of the coal seam and are in communication with the two horizontal main roadways 3. The one or more connecting roadways 5 are configured to connect the two horizontal main roadways 3 to meet the requirements for ventilation or passage.

Every two adjacent connecting roadways 5 are spaced apart by a preset interval, and preferably, the connecting roadways 5 are parallel to each other and evenly distributed throughout the mine field.

According to an embodiment of the present application, an unmanned automatic mining machine has a large length and a large turning radius. Therefore, the intersections of these roadways are each arranged in the shape of a circular arc, in order to allow the unmanned automatic mining machine to pass.

In addition, the mine field sump 10 is arranged in a preset range of the bottom of the air shaft 2 and is configured to store water extracted from coal and rock seams to prevent water in the coal and rock seams from affecting the mining of the coal seam. Of course, according to other embodiments of the present application, the mine field sump 10 may not be arranged according to the practical requirements.

In addition, the shaft station 6 may be constructed at the shallow horizontal coal seam zone where the bottom of the main shaft 1 is located. The fluidized conversion chamber 7 and the shaft station sump 9 are constructed in the shaft station 6.

The fluidized conversion chamber 7 is configured to convert the coal resources into fluidized energy product and/or electricity.

The shaft station sump 9 is configured to store water which is extracted when constructing each chamber in the shaft station.

As shown in FIG. 2, the energy transmission pipelines 8 are arranged in the horizontal main roadways 3, the inclined main roadways 4, the connecting roadways 5 and the main shaft 1. The energy transmission pipelines are configured to transmit energy required for the normal operation of the unmanned automatic mining machine and also to transmit energy converted from the coal resources to the ground.

The specific process of constructing the mine field using the mind field layout method will be described hereinafter.

The main shaft 1 and the air shaft 2 are drilled and excavated vertically from the ground, then the unmanned automatic mining machine is transported to the bottom of the main shaft 1, and the horizontal main roadways 3, the inclined main roadways 4 and the contacting roadways 5 are excavated by the unmanned automatic mining machine.

The coal raw materials generated by the unmanned automatic mining machine when excavating the roadways are transported by an underground intelligent shuttle car to the fluidized conversion chamber 7, and are sorted to obtain coal and gangue. The coal is converted into the fluidized energy products and/or the electricity in the fluidized conversion chamber 7, and then the fluidized energy product is transported to the ground through the energy transmission pipelines to be collected; the gangue are directly raised to the ground.

During the roadway excavation or coal mining, an inert gas is filled into each roadway from the ground through the main shaft 1, to squeeze and discharge the harmful gas such as gas through the air shaft 2. Optionally, the discharged gas can be collected on the ground.

After the completion of the shaft construction in the mind field, the unmanned automatic mining machine can be used for the fluidized mining of coal resources. The mining process is as follows.

The unmanned automatic mining machine starts to mine the coal resources from a mining starting point 100 which is located at a corner of the deep horizontal coal seam zone of the mine field, for example, the mining starting point and the shaft station 6 are distributed at adjacent corners. The unmanned automatic mining machine can use a two-direction coal mining mode, and one coal mining cycle includes two "strip-shaped" routes along the strike of the coal seam, which are a forward coal mining route 101 and a backward coal mining route 102.

Specifically, the unmanned automatic mining machine performs the forward coal mining from right to left from the mining starting point, and when reaching the left boundary of the mine field, the unmanned automatic mining machine is shifted to the backward coal mining, that is, the unmanned automatic mining machine starts to mine coal from the left boundary of the mine field to the right boundary of the mine field, and thus one coal mining cycle is completed. The "strip-shaped" routes of the coal mining cycle are parallel to each other and are adjacently distributed.

The mined raw coal is crushed in a compartment of the unmanned automatic mining machine, then is sorted, and then is converted in-situ in the compartment into the fluidized energy product and/or the electricity, and the fluidized energy product and/or the electricity is temporarily stored in the compartment.

In the process of coal mining, the unmanned automatic mining machine passes through the inclined main roadways 4 and the multiple connecting roadways 5, and when arriving at the inclined main roadways 4 or the connecting roadways 5, the unmanned automatic mining machine can be connected to the energy transmission pipelines in the roadways, to replenish energy and water sources according to itself operation and to transport energy to the ground according to the storage amount of the fluidized energy resources and/or the electricity.

In the mine field layout according to this embodiment, the main shaft and the air shaft are drilled from the ground at two diagonal positions in the mine field, the bottom of the main shaft is located in the shallow horizontal coal seam zone, and the bottom of the air shaft is located in the deep horizontal coal seam zone. The horizontal main roadways, that is the first horizontal main roadway and the second horizontal main roadway, are excavated at two boundaries of the mine field along the strike of the coal seam, and two inclined main roadways, that is the first inclined main roadway and the second inclined main roadway, are excavated at two boundaries of the mine field along the dip direction of the coal seam. One or more connecting roadways are located inside the mine field, and are in communication with the two horizontal main roadways. In the coal mining stage, the mined coal resources can be directly converted into the fluidized energy product and/or electricity in the mine by the fluidized mining method. The energy transmission pipelines arranged in the main shaft, the horizontal main roadways, the inclined main roadways and the connecting roadways are configured to supply energy to the coal mining machine in the mine and also to transport the fluidized energy product and/or the electricity obtained by the conversion to the ground. It can be seen that only two vertical shafts (the main shaft and the air shaft), four main roadways, one or more connecting roadways need to be constructed in the mine field, and it is not necessary to construct the shafts for coal lifting and transportation, and thus the number of shafts for drainage, ventilation, and power supply is reduced. Therefore, the construction and maintenance costs of the roadway are reduced. In addition, there is basically no residual coal pillar left in the mine field, and the recovery ratio is high.

Figure 3:
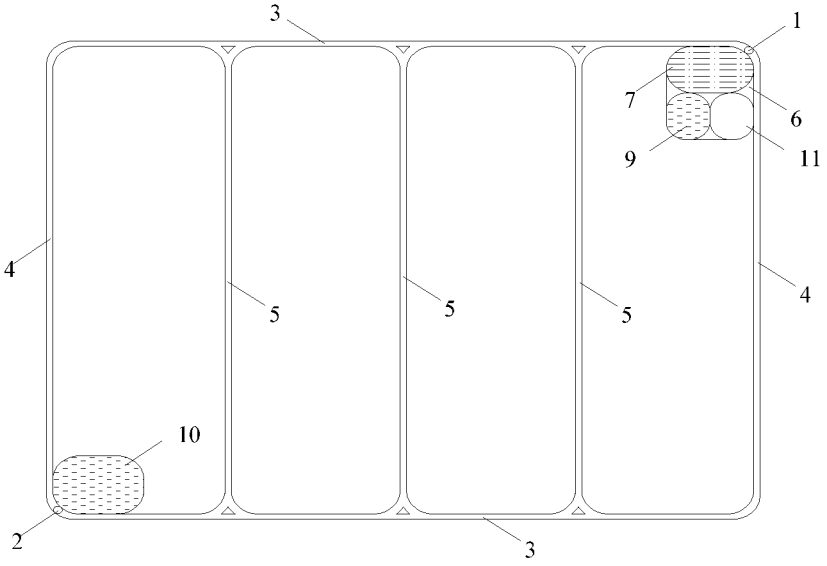
FIG. 3 is a top view showing the structure of another mine field layout method suitable for fluidized mining of coal resources according to an embodiment of the present application.

Referring to FIG. 3, FIG. 3 is a top view of another mine field layout suitable for fluidized mining of coal resources according to an embodiment of the present application, and the gas power station is constructed in the shaft station of the mine field of this embodiment.

When excavating the horizontal main roadways 3, the inclined main roadways 4, and the connecting roadways 5, the unmanned automatic mining machine is used to extract gas in the coal seams at both sides of each roadway, and the extracted gas is transported to the gas power station 11 and converted into electricity, and the electricity is transported to the ground. The gas power station can directly convert the gas extracted from the coal seam into the electricity to avoid gas in the coal seam from causing gas outburst and other disasters in the mine.

Figure 4:
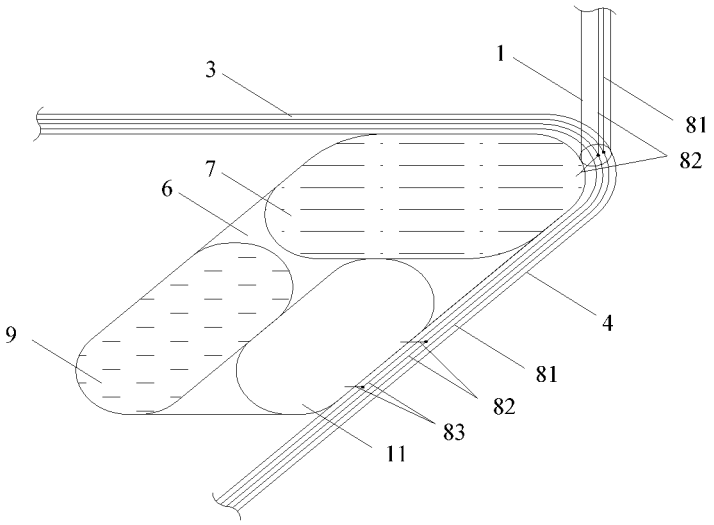
FIG. 4 is a top view showing an arrangement of pipelines near a shaft station in a mine field layout according to an embodiment of the present application.

According to an embodiment of the present application, as shown in FIG. 4, the energy transmission pipelines 8 arranged along the sidewall of the main shaft 1 include an energy charging pipeline 81 and an energy extracting pipeline 82; the energy transmission pipelines 8 arranged along the sidewalls of the horizontal main roadways 3, the inclined main roadways 4, and the connecting roadways 5 include an energy charging pipeline 81, an energy extracting pipeline 82, and a gas transporting pipeline 83. The above three types of pipelines are all provided with ports that can be connected to the unmanned automated coal mining machine.

The energy charging pipelines 81 are configured to provide resources, such as energy and water, to the unmanned automatic mining machine for its normal operation. The energy extracting pipelines 82 are configured to transport the fluidized energy product and/or electricity obtained by the conversion to the ground. The gas transportation pipelines 83 are configured to transport the gas extracted by the unmanned automatic mining machine to the gas power station 11.

In the mine field layout according to this embodiment, the gas power station is constructed in the shaft station, the gas is extracted from the coal seam at both sides of each roadway during the roadway excavation process, the extracted gas is transported to the gas power station for power generation, and the obtained electricity is transported to the ground. The potentially dangerous gas is converted into safe electricity and the electricity is transported to the ground, which avoids gas disasters such as gas outburst in the mine during the coal seam mining, and improves the safety of the mine field.

Figure 5:
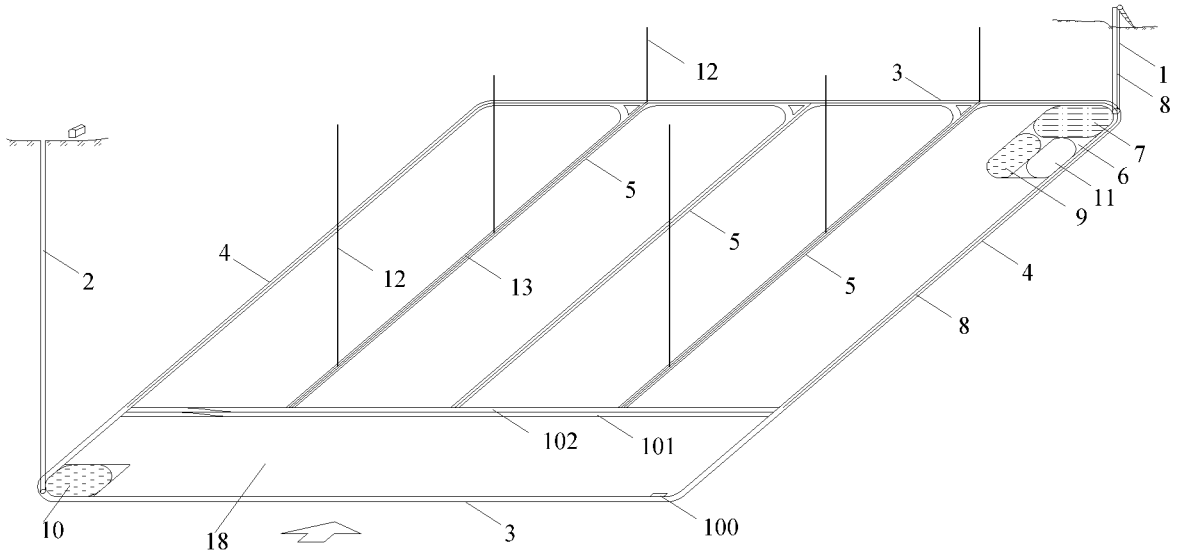
FIG. 5 is an overall schematic view of another mine field layout suitable for fluidized mining of coal resources according to an embodiment of the present application.

Referring to FIG. 5, FIG. 5 is an overall view of another mine field layout suitable for fluidized mining of coal resources according to an embodiment of the present application. The mine field of this embodiment is further provided with filling boreholes 12 and filling pipelines 13.

The multiple filling boreholes 12 are drilled from the ground to the connecting roadways, and the filling pipelines 13 are arranged along the connecting roadways 5. The filling pipelines 13 can be arranged at the same inclination angle as the connecting roadways 5.

The filling boreholes 12 are intersected with the filling pipelines 13, to transport the filling slurry from the ground into the mine.

Figure 6:
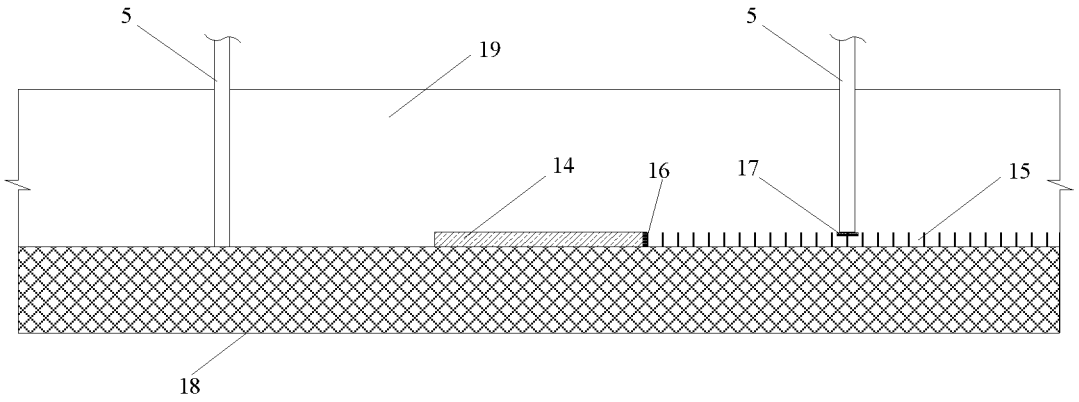
FIG. 6 is a top view showing an arrangement of a filling wall in a mine field layout according to an embodiment of the present application.

As shown in FIG. 6, the coal seam of unmined coal and rock seams 19 is mined by the unmanned automatic mining machine 14, and the mined area is called as a goaf 15. In order to prevent the collapse of the goaf 15, the "strip-shaped" goaf 15 is filled in time.

According to an embodiment of the present application, after the unmanned automatic mining machine 14 has mined the coal for a certain distance, a first filling wall 16 is constructed behind the unmanned automatic mining machine 14, and the plane of the first filling wall 16 is perpendicular to the advancing direction of the unmanned automatic mining machine 14, so that the unmanned automatic mining machine 14 is isolated from the "strip-shaped" goaf 15 behind it, effectively preventing the filling slurry from coming into contact with the unmanned automatic mining machine 14 that is mining coal.

If the goaf 15 comes across one connecting roadway 5, in this case, a second filling wall 17 perpendicular to the connecting roadway 5 needs to be constructed at the port of the connecting roadway 5, for blocking the port of the connecting roadway 5, and preventing the filling slurry from flowing into the connecting roadway 5.

The filling slurry is transported from the ground into the shaft through the vertical filling boreholes 12, and then the filling slurry is transported to the goaf 15 through the filling pipelines 13 provided in the connecting roadways 5. The filling slurry is mixed with the gangue separated during the coal mining stage and the residual material generated by the fluidized conversion reaction to fill the goaf 15, thereby forming a filling area 18.

A mine field layout suitable for fluidized mining of coal resources is provided according to an embodiment of the present application. The vertical filling boreholes are drilled from the ground to the connecting roadways, also the filling pipelines are arranged in the connecting roadways, and thus the filling slurry is transported to from the ground into the goaf by the filling boreholes and the filling pipelines. The filling area is formed by the filling slurry filling the goaf, preventing the collapse of the goaf and improving the safety of the mine field. This kind of mine field layout is especially suitable for situations with deep depths, for example, for the mine field below 2000 meters, which expands the scope of application of the mine field layout.

A mine field layout suitable for fluidized mining of coal resources is also provided according to an embodiment of the present application.

Solution 1: A mine field layout suitable for fluidized mining of coal resources is provided, the mine field includes a first boundary extending along the strike of a coal seam and located in a shallow horizontal coal seam zone, a second boundary extending along the strike of the coal seam and located in a deep horizontal coal seam zone, a third boundary extending along a dip direction of the coal seam and a fourth boundary extending along the dip direction of the coal seam, and the first boundary, the second boundary, the third boundary, and the fourth boundary forms a quadrilateral mine field area, and the mine field layout includes: a main shaft, an air shaft, a first horizontal main roadway, a second horizontal main roadway, a first inclined main roadway, a second inclined main roadway, connecting roadways, a shaft station, a mine field sump and energy transmission pipelines;

a bottom of the main shaft is located at one end of the first boundary;

a bottom of the air shaft is located at one end of the second boundary;

the first horizontal main roadway extends along the first boundary, and the second horizontal main roadway extends along the second boundary;

the first inclined main roadway extends along the third boundary, and the second inclined main roadway extends along the fourth boundary;

the connecting roadways are located inside the mine field, extend along the dip direction of the coal seam and are each in communication with the first horizontal main roadway and the second horizontal main roadway;

the mine field sump is located within a preset range of the bottom of the air shaft and is configured to store water extracted from coal and rock seams;

the shaft station is located at the bottom of the main shaft;

the fluidized conversion chamber is located in the shaft station and is configured to convert the coal resources mined during excavating the roadways into at least one of a fluidized energy product and electricity;

the shaft station sump is located in the shaft station and is configured to store water extracted when constructing a chamber; and the energy transmission pipelines are arranged in the first horizontal main roadway, the second horizontal main roadway, the first inclined main roadway, the second inclined main roadway, the connecting roadways and the main shaft, and are configured to transmit energy to an unmanned automatic mining machine in the mine field and to transport at least one of the fluidized energy product and electricity converted from coal resources to the ground.

Solution 2: in the mine field layout according to Solution 1, the bottom of the main shaft and the bottom of the air shaft are at diagonal positions in the quadrilateral mine field area.

Solution 3: in the mine field layout according to Solution 1, the mine field layout further includes a gas power station provided in the shaft station, and the gas power station is configured to convert the gas extracted from the coal seam during excavating the roadways into electricity.

Solution 4: in the mine field layout according to Solution 1, the mine field layout further includes filling boreholes and filling pipelines;

the filling boreholes extend from the ground to the connecting roadways and are configured to transport filling slurry to the connecting roadways; and the filling pipelines are arranged in the connecting roadways, are in communication with the filling boreholes and are configured to transport the filling slurry to a goaf.

Solution 5: in the mine field layout according to Solution 4, an installation angle of the filling pipelines is the same as an inclination angle of the connecting roadways.

Solution 6: in the mine field layout according to Solution 4, the mine field layout further includes:

a first filling wall constructed behind the unmanned automatic mining machine when the goaf is being filled, and a plane of the first filling wall is perpendicular to the direction of a coal mining route.

Solution 7: in the mine field layout according to any one of Solutions 4 to 6, the mine field layout further includes:

a second filling wall constructed at an intersection of the goaf and the connecting roadway when the goaf is being filled and the goaf is intersected with the contacting roadway, and the plane of the second filling wall is perpendicular to the contacting roadway.

Solution 8: in the mine field layout according to any one of Solutions 1 to 3, the energy transmission pipelines arranged in the main shaft include energy charging pipelines and energy extracting pipelines;

the energy charging pipelines are configured to transmit energy for the normal operation of the unmanned automatic mining machine; and the energy extracting pipelines are configured to transmit energy converted from coal resources to the ground.

Solution 9: in the mine field layout according to Solution 3, the energy transmission pipelines in the first horizontal main roadway, the second horizontal main roadway, the first inclined main roadway, the second inclined main roadway and the connecting roadways include: energy charging pipelines, energy extracting pipelines and gas transportation pipelines;

the energy charging pipelines are configured to transmit energy for the normal operation of the unmanned automatic mining machine;

the gas transportation pipelines are configured to transmit the gas extracted from the coal seam to the gas power station, to allow the gas to be converted into electricity by the gas power station; and the pumping pipelines are configured to transport at least one of the fluidized energy product and electricity converted from coal resources by the unmanned automatic mining machine to the energy transmission pipelines in the main shaft, to allow the energy transmission pipelines in the main shaft to transport at least one of the fluidized energy product and electricity to the ground.

It should be noted that, the above embodiments are described in a progressive manner. Each of the embodiments is mainly focused on describing its differences from other embodiments, and references may be made among these embodiments with respect to the same or similar portions among these embodiments.

For the above method embodiments, for the purposes of simple description, the foregoing method embodiments are described as a series of action combinations, but those skilled in the art should be aware that the present application is not limited by the described action sequence, because according to the present application, certain steps may be performed in other orders or simultaneously. Secondly, those skilled in the art should also be aware that the embodiments described in the specification are preferred embodiments and that the actions and modules involved may not be necessarily required for the present application.

Finally, it should be noted that, relational terms such as first and second herein are used only to distinguish one entity or operation from another entity or operation, without necessarily requiring or implying any such actual relationship or order between these entities or operations. Moreover, the term "include", "comprise" or any other variation thereof is intended to cover non-exclusive inclusions, so that a process, a method, an object or a device including a series of elements includes not only those elements, but also other elements that are not explicitly listed, or the elements inherent in the process, the method, the object or the device. In the absence of further restrictions, elements limited by the statement "includes one . . . " do not exclude the existence of other identical elements in processes, methods, articles or equipment that include the said elements.

Based on the above description of the disclosed embodiments, the person skilled in the art is capable of carrying out or using the present application. It is obvious for the person skilled in the art to make many modifications to these embodiments. The general principle defined herein may be applied to other embodiments without departing from the spirit or scope of the present application. Therefore, the present application is not limited to the embodiments illustrated herein, but should be defined by the broadest scope consistent with the principle and novel features disclosed herein.

The embodiments described hereinabove are only preferred embodiments of the present application. It should be noted that, for the person skilled in the art, several modifications and improvements may be made without departing from the principle of the present application, and these modifications and improvements are also deemed to fall into the scope of protection of the present application.

The invention claimed is:

1. A mine field layout method suitable for fluidized mining of a coal seam, the mine field comprising a first boundary extending along a strike of the coal seam and located in a shallow horizontal coal seam zone, a second boundary extending along the strike of the coal seam and located in a deep horizontal coal seam zone, a third boundary extending along a dip direction of the coal seam and a fourth boundary extending along the dip direction of the coal seam, and the first boundary, the second boundary, the third boundary, and the fourth boundary forming a quadrilateral mine field area, wherein the mine field layout method comprises:

providing a main shaft and an air shaft, wherein a bottom of the main shaft is located at one end of the first boundary, and a bottom of the air shaft is located at one end of the second boundary;

providing a first horizontal main roadway and a second horizontal main roadway, wherein the first horizontal main roadway extends along the first boundary, and the second horizontal main roadway extends along the second boundary;

providing a first inclined main roadway and a second inclined main roadway, wherein the first inclined main roadway extends along the third boundary, and the second inclined main roadway extends along the fourth boundary;

providing one or more connecting roadways, wherein the one or more connecting roadways are located inside the mine field, extend along the dip direction of the coal seam and are each in communication with the first horizontal main roadway and the second horizontal main roadway;

providing a shaft station, wherein the shaft station is located at the bottom of the main shaft;

providing a mine field sump, wherein the mine field sump is located within a preset range of the bottom of the air shaft and is configured to store water extracted from the coal seam;

providing a fluidized conversion chamber, wherein the fluidized conversion chamber is located in the shaft station and is configured to convert the coal seam mined during excavating the roadways into at least one of a fluidized energy product and electricity;

providing a shaft station sump, wherein the shaft station sump is located in the shaft station and is configured to store water extracted when constructing the fluidized conversion chamber; and providing energy transmission pipelines, wherein the energy transmission pipelines are arranged in the first horizontal main roadway, the second horizontal main roadway, the first inclined main roadway, the second inclined main roadway, the one or more connecting roadways and the main shaft, and are configured to transmit energy for normal operation of an unmanned automatic mining machine in the mine field and to transport at least one of the fluidized energy product and electricity converted from the coal seam to above ground.

2. The mine field layout method according to claim 1, wherein the bottom of the main shaft and the bottom of the air shaft are at diagonal positions in the quadrilateral mine field area.

3. The mine field layout method according to claim 2, wherein the energy transmission pipelines comprise energy charging pipelines and energy extracting pipelines;

the energy charging pipelines are configured to transport energy for normal operation of the unmanned automatic mining machine; and the energy extracting pipelines are configured to transport energy converted from the coal seam to the above ground.

4. The mine field layout method according to claim 1, further comprising:

providing a gas power station in the shaft station, wherein the gas power station is configured to convert gas extracted from the coal seam during excavating the roadways into electricity.

5. The mine field layout method according to claim 4, wherein the energy transmission pipelines in the first horizontal main roadway, the second horizontal main roadway, the first inclined main roadway, the second inclined main roadway and the one or more connecting roadways comprise: energy charging pipelines, energy extracting pipelines and gas transportation pipelines;

the energy charging pipelines are configured to transport energy for normal operation of the unmanned automatic mining machine in the mine field;

the gas transportation pipelines are configured to transport the gas extracted from the coal seam to the gas power station, to allow the gas power station to convert the gas into electricity; and the energy extracting pipelines are configured to transport at least one of the fluidized energy product and electricity converted from the coal seam by the unmanned automatic mining machine to the energy transmission pipelines in the main shaft, to allow the energy transmission pipelines in the main shaft to transport at least one of the fluidized energy product and electricity converted from the coal seam to the above ground.

6. The mine field layout method according to claim 4, wherein intersections of the roadways are each arranged in a shape of a circular arc.

7. The mine field layout method according to claim 4, wherein the energy transmission pipelines comprise energy charging pipelines and energy extracting pipelines;

the energy charging pipelines are configured to transport energy for normal operation of the unmanned automatic mining machine in the mine field; and the energy extracting pipelines are configured to transport energy converted from the coal seam to the above ground.

8. The mine field layout method according to claim 1, further comprising:

providing filling boreholes and filling pipelines; wherein, the filling boreholes extend from the ground to the one or more connecting roadways, and are configured to transport filling slurry to the one or more connecting roadways; and the filling pipelines are arranged in the one or more connecting roadways and are in communication with the filling boreholes, and are configured to transport the filling slurry to a goaf.

9. The mine field layout method according to claim 8, wherein an installation angle of the filling pipelines is the same as an inclination angle of the one or more connecting roadways.

10. The mine field layout method according to claim 8, further comprising:

providing a first filling wall behind the unmanned automatic mining machine when the goaf is being filled, wherein a plane of the first filling wall is perpendicular to a direction of a coal mining route.

11. The mine field layout method according to claim 10, comprising:

providing a second filling wall constructed at an intersection of the goaf and the one or more connecting roadways when the goaf is being filled and the goaf is intersected with the one or more connecting roadways, and the plane of the second filling wall is perpendicular to the one or more connecting roadways.

12. The mine field layout method according to claim 1, wherein the energy transmission pipelines comprise energy charging pipelines and energy extracting pipelines;

the energy charging pipelines are configured to transport energy for normal operation of the unmanned automatic mining machine in the mine field; and the energy extracting pipelines are configured to transport at least one of the fluidized energy product and electricity converted from the coal seam to the above ground.

* * * * *